United States Patent [19]

Taylor

[11] 4,102,685

[45] Jul. 25, 1978

[54] PHOTOGRAPHIC USES OF POLYVINYLPHENYLMERCAPTO-TETRAZOLE:MULTIVALENT METAL CATION COMBINATIONS

[75] Inventor: Lloyd D. Taylor, Lexington, Mass.

[73] Assignee: Polaroid Corporation, Cambridge, Mass.

[21] Appl. No.: 718,043

[22] Filed: Aug. 26, 1976

[51] Int. Cl.[2] ..... G03C 1/40; G03C 1/76; G03C 1/48; G03C 1/72

[52] U.S. Cl. ..... 96/73; 96/74; 96/76 R; 96/77; 96/114

[58] Field of Search ..... 96/76 R, 77, 73, 74, 96/96, 97, 114; 260/79

[56] References Cited

U.S. PATENT DOCUMENTS

| | | | |
|---|---|---|---|
| 3,748,129 | 7/1973 | Autges et al. | 96/77 |
| 3,787,209 | 1/1974 | Land | 96/76 R |
| 3,936,401 | 2/1976 | Grasshoff et al. | 260/79 |

*Primary Examiner*—Dennis E. Talbert, Jr.
*Assistant Examiner*—Richard L. Schilling
*Attorney, Agent, or Firm*—Esther A. H. Hopkins

[57] ABSTRACT

Diffusion transfer photographic products are disclosed which comprise a support carrying at least a photosensitive silver halide emulsion layer, a dye image-forming material and a layer comprising polymeric derivatives of tetrazole-5-thiols. Associated with this photographic product is a multivalent metal cation which diffuses to the layer comprising the polymeric derivatives of tetrazole-5-thiols to increase the permeability of said tetrazole-5-thiol containing layer to the dye image-forming material.

68 Claims, 2 Drawing Figures

PHOTOGRAPHIC USES OF POLYVINYLPHENYLMERCAPTO-TETRAZOLE:-MULTIVALENT METAL CATION COMBINATIONS

BACKGROUND OF THE INVENTION

This invention relates to photography and more particularly to photographic products particularly adapted for employment in photographic diffusion transfer color processes. These processes are now well known. A photosensitive element with diffusion transfer utility, containing a dye developer and a silver halide emulsion may be exposed to actinic radiation and wetted by a liquid processing composition in the dark, and the exposed photosensitive element may be superposed prior to, during, or after wetting, on a sheet-like support element which may be utilized as an image-receiving element. In a preferred embodiment, the liquid processing composition is applied to the photosensitive element in a substantially uniform layer as the photosensitive element is brought into superposed relationship with the image-receiving layer. The liquid processing composition, positioned intermediate the photosensitive element and the image-receiving element, permeates the emulsion to initiate development of the latent image contained therein. The dye developer is immobilized or precipitated in exposed areas as a consequence of the development of the latent image. This immobilization is apparently, at least in part, due to a change in the solubility characteristics of the dye developer upon oxidation and especially as regards its solubility in alkaline solutions. It may also be due in part to a tanning effect on the emulsion by oxidized developing agent, and in part to a localized exhaustion of alkali as a result of development. In undeveloped and partially developed areas of the emulsion, the dye developer is unreacted and diffusible and thus provides an imagewise distribution of unoxidized dye developer dissolved in the liquid processing composition, as a function of the point-to-point degree of exposure of the silver halide emulsion. At least part of this imagewise distribution of unoxidized dye developer is transferred, by imbibition, to a superposed image-receiving layer or element, said transfer substantially excluding oxidized dye developer. The image-receiving element receives a depthwise diffusion, from the developed emulsion, of unoxidized dye developer without appreciably disturbing the imagewise distribution thereof to provide the reversed or positive color image of the developed image. The image-receiving element may contain agents adapted to mordant or otherwise fix the diffused, unoxidized dye developer. If the color of the transferred dye developer is affected by changes in the pH of the image-receiving element, this pH may be adjusted in accordance with well-known techniques to provide a pH affording the desired color. The desired positive image is revealed by stripping the image-receiving layer from the photosensitive element at the end of a suitable imbibition period.

Multicolor images may be obtained by diffusion transfer processing using color image-forming components such as, for example, the previously mentioned dye developers, by several techniques. One such technique contemplates obtaining multicolor transfer images utilizing dye developers by employment of an integral multi-layer photosensitive element, such as is disclosed in U.S. Pat. No. 2,983,606, and particularly with reference to FIG. 9 of the patent's drawing, wherein at least two selectively sensitized photosensitive strata, superposed on a single, dimensionally stable support are processed simultaneously and without separation, with a single, common image-receiving layer. A suitable arrangement of this type comprises a support carrying a red-sensitive silver halide emulsion stratum, a green-sensitive silver halide emulsion stratum and a blue-sensitive silver halide emulsion stratum, said emulsions having associated therewith, respectively, for example, a cyan dye developer, a magenta dye developer and a yellow dye developer. The dye developer may be utilized in the silver halide emulsion layer, for example, in the form of particles, or it may be employed as a layer behind the appropriate silver halide emulsion strata. Ideally, each dye developer should develop only contiguous silver halide, to wit, the cyan dye developer should develop only the red-sensitive silver halide emulsion layer, the magenta dye developer should develop only the green-sensitive halide emulsion layer, and the yellow dye developer should develop only the blue-sensitive silver halide emulsion layer in a conventional three-color system. However, in practice, each dye developer has been found to develop to an undesirable extent each silver halide emulsion layer. The result of this effect is to produce color contamination and desaturation of colors in the transfer prints. Each set of silver halide emulsion and associated dye developer strata are disclosed to be optionally separated from other sets by suitable interlayers, for example, by a layer of gelatin or polyvinyl alcohol. In certain instances, it may be desirable to incorporate a yellow filter in front of the green-sensitive emulsion and such yellow filter may be incorporated in an interlayer or in the yellow dye layer. However, where desirable, a yellow dye developer of the appropriate spectral characteristics and present in a state capable of functioning as a yellow filter may be employed. In such instances, a separate yellow filter may be omitted.

BRIEF SUMMARY OF THE INVENTION

It is a primary object of the present invention to provide novel photographic diffusion transfer color processes and novel photosensitive elements particularly adapted for employment in such processes.

A further object of the present invention is to provide products for use in photographic diffusion transfer color processes which include a photosensitive element which comprises a plurality of essential layers superposed upon a common support including at least two selectively sensitized photosensitive layers each having associated therewith a dye image-forming material which is soluble and diffusible in alkali, such photosensitive layers being separated by interlayers comprising certain polymeric derivatives of tetrazole-5-thiols as described more fully below, said photosensitive element also comprising multivalent metal cations which diffuse to said interlayers to increase the permeability of said interlayers and said dye image-forming material.

Another object of the present invention is to provide a product for use in photographic diffusion transfer color processes which include a photosensitive element which comprises a plurality of layers superposed upon a common support including at least two selectively sensitized photosensitive layers each having associated therewith a layer containing an alkali-soluble and diffusible dye image-forming material, said dye image-forming material being dispersed in the polymeric derivatives of the tetrazole-5-thiols described below, said photosensitive element also comprising multivalent metal cations which diffuse to said layer containing dye image-forming material to increase the permeability of said dye containing layer to the dye image-forming material.

Another object of the present invention is to provide a product for use in a photographic diffusion transfer color process comprising a photosensitive element, as described above, in combination with a photographic diffusion transfer image-receiving composite structure comprising a plurality of essential layers including a solution-dyeable polymeric layer.

Further, it is an object of the present invention to provide a product for use in a diffusion transfer photographic color process which product comprises a photosensitive element and transfer image-receptive composite structure each as identified above and a fluid photographic processing composition.

Other objects of the invention will in part be obvious and will in part appear hereinafter.

The invention accordingly comprises the product possessing the features, properties and the relation of components, and the process involving the several steps and the relation and order of one or more of such steps with respect to each of the others which are exemplified in the following detailed disclosure, and the scope of the application of which will be indicated in the claims.

For a fuller understanding of the nature and objects of the invention, reference should be had to the following detailed description taken in connection with the accompanying drawing, wherein:

FIG. 1 is an enlarged diagrammatic fragmentary section view illustrating one aspect of this invention, and FIG. 2 is a similar view illustrating another aspect of the invention.

DETAILED DESCRIPTION OF THE INVENTION

Figure 1:
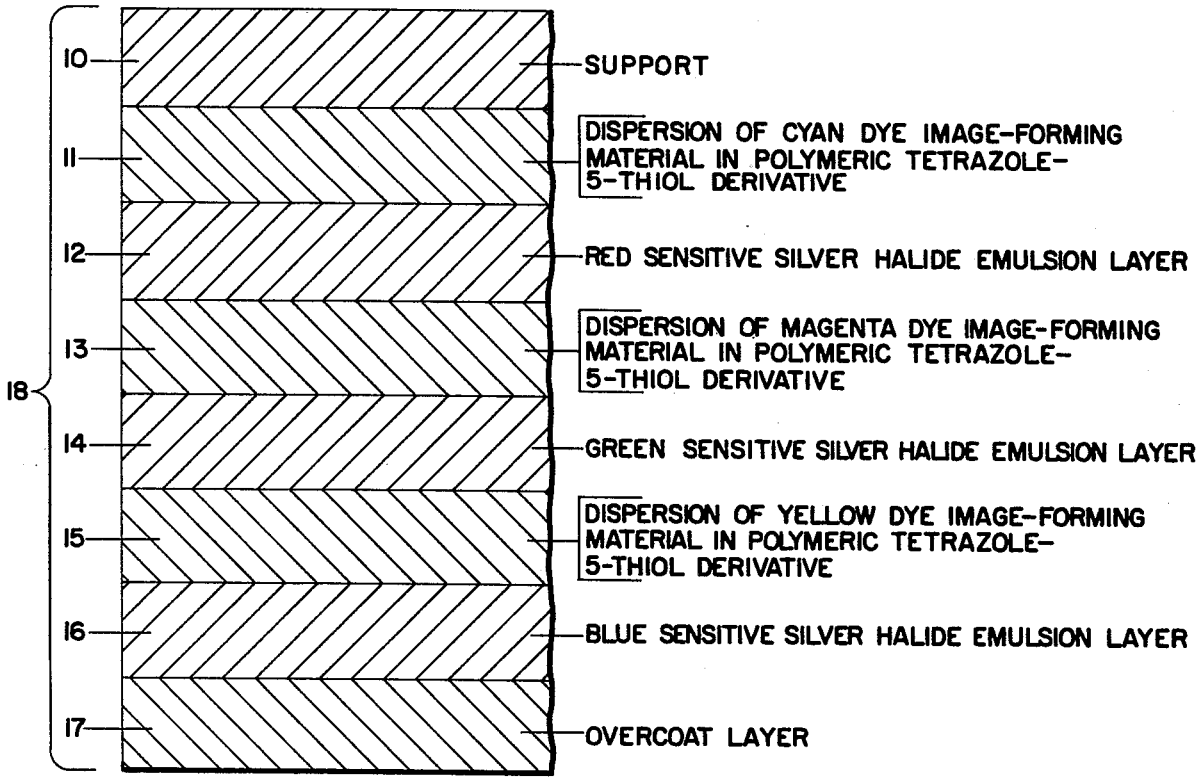

It has been discovered that the employment of tetrazole-5-thiols and their metal and ammonium salts in a diffusion transfer photosensitive film unit, as disclosed in copending U.S. Patent Application of Jerome Reid and Michael Grasshoff, Ser. No. 718,012, filed Aug. 26, 1976 now abandoned and replaced by Ser. No. 783,552, filed Apr. 1, 1977 and assigned to the same assignee, in conjunction with a multivalent metal cation provides unexpected interimage control and high dye densities with low stain levels. Of particular significance are embodiments where the tetrazole-5-thiol material is employed as an interlayer between adjacent silver halide emulsions or as an image-forming material dispersant — a multivalent metal cation being available to associate with the tetrazole-5-thiol material by diffusion from elsewhere in the system. The polymeric derivatives of tetrazole-5-thiols employed in the present invention are compounds of the following formula:

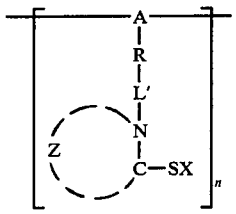

wherein A is an ethylenically unsaturated group which has been polymerized, R is a resonance stabilized group, L' is an optional linking group, X is alkali metal, primary, secondary, tertiary or quaternary ammonium, Z represents the atoms and bonds necessary to complete a tetrazole ring and $n$ is an integer of at least 100.

For example, among the specific compounds included within the scope of this invention are the following thiols, their potassium and other alkali metal salts, their primary, secondary, tertiary and quaternary ammonium salts such as, for example, their tetramethyl ammonium salts poly[1-(p-vinylphenyl)-1,2,3,4-tetrazole-5-thiol],

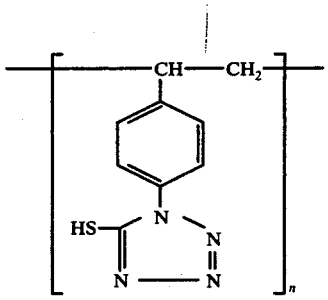

poly[1-(p-vinylbenzyl)-1,2,3,4-tetrazole-5-thiol],

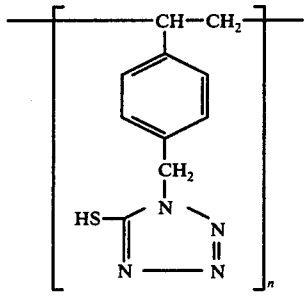

poly[1-(m-acrylamido-phenyl)-1,2,3,4-tetrazole-5-thiol],

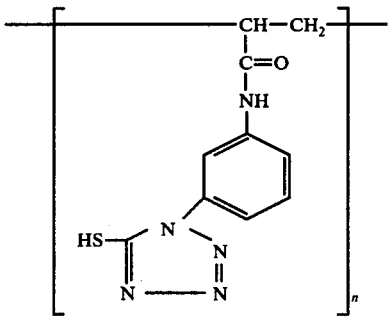

poly[1-(m-(2-acrylamido-2-methyl)-propionamido-phenyl)-1,2,3,4-tetrazole-5-thiol],

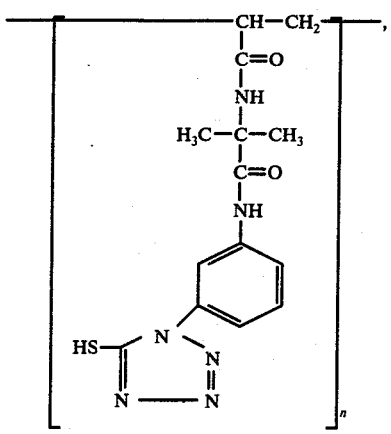

and 1-(p-formylphenyl)-tetrazole-5-thiol polyvinyl acetal

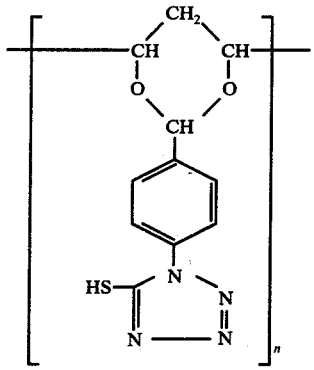

These compounds may be prepared by the methods detailed in U.S. Pat. No. 3,936,401.

It will be recognized that these compounds may exist in tautomeric thione form as indicated in the above mentioned patent.

It has now specifically been discovered that the employment of metal ions with valences greater than one as, for example, divalent ions such as calcium, magnesium or nickel, or trivalent ions, such as, aluminum or tetra-valent ions, such as, titanium, zirconium, or hafnium in conjunction with polymeric derivatives of the tetrazole-5-thiols described above in a photosensitive film unit provides excellent interimage control and acceptable density maxima.

The metal ions are added to the photosensitive element in a layer other than the layer comprising the polymeric tetrazole-5-thiol to avoid premature metal salt precipitation. They may be added in one of the essential layers, as a wash coat on top of the last layer deposited or in the processing composition. A convenient way of providing the polyvalent cations to the polymeric tetrazole-5-thiol layer to promote in situ precipitation is to include the metal ions in the layer deposited next before the polymeric tetrazole-5-thiol layer, relying on the water content of the still wet coated layer to allow the requisite layer-to-layer diffusion of the metal cations. The polyvalent metal ion, upon diffusion into the polymeric tetrazole-5-thiol-coating layer appears to increase the permeability of that layer to diffusing dye image-forming material.

Interlayers between each set of silver halide layers and associated dye image-providing materials, may be manufactured as disclosed, for example, in U.S. Pat. No. 3,756,816 wherein the coating dispersion is disclosed to be a latex permeator composition containing the appropriate ratios of ingredients formed by the addition of an aqueous solution of a permeator to a latex emulsion. "Permeator" is used herein as defined in the aforementioned patent as a material which provides predetermined image-forming dye permeation characteristics to a coalesced latex, the latex comprising a synthetic polymer. It will be appreciated that coating solutions comprising admixtures of aqueous solutions and latex emulsions carry with them the inherent instability of mutually suspended nonmiscible components, and that "pot life" and therefore the range of time in which said coating solutions may be used as coating solutions without further treatment is a function of the onset of phase separation. A solution to this problem, obviating the use of these admixtures made possible by the use of the polymeric tetrazole-5-thiol derivatives of this invention, is the preparation of satisfactory negative interlayers from materials which are water soluble, providing stable solutions for handling and coating. A satisfactory negative interlayer must, of course, act to provide a barrier with respect to retardation of the positional displacement of the dye image-providing material prior to establishment of substantial imagewise emulsion control of the associated dye image-providing material's diffusion, and must be capable of providing an ultimately clear film. Such interlayers are formed from the polymeric tetrazole-5-thiol derivatives used in this invention, and the addition of the polyvalent metal cations makes the interlayer permeable enough to provide better dye density maxima while promoting the interimage control necessary for satisfactory diffusion transfer photographs than tetrazole-5-thiol delay-release systems which do not employ a multivalent metal cation.

The polymeric tetrazole-5-thiol derivatives described in this invention may be used as dispersants for the dye image-forming materials. This use makes it possible to avoid separate barrier layers by combining the barrier function with the dye image-forming layer as disclosed in U.S. Pat. No. 3,748,129 issued July 23, 1973 to J. A. Aotges, J. L. Reid, H. N. Schlein and L. D. Taylor.

An embodiment of this invention is shown in FIG. 1. Photosensitive element 18 comprises a support 10; a layer 11 comprising a dispersion of cyan dye image-forming material in a polymeric tetrazole-5-thiol derivative according to this invention; a layer 12 comprising a red sensitive silver halide emulsion and a multivalent metal ion; a layer 13 comprising a dispersion of magenta dye image-forming material in a polymeric tetrazole-5-thiol derivative according to this invention; a layer 14 comprising a green-sensitive silver halide emulsion; a layer 15 comprising a dispersion of yellow dye image-forming material in a polymeric tetrazole-5-thiol derivative according to this invention; a layer 16 comprising a blue sensitive silver halide emulsion; and 17 is a protective overcoat layer.

Figure 2:
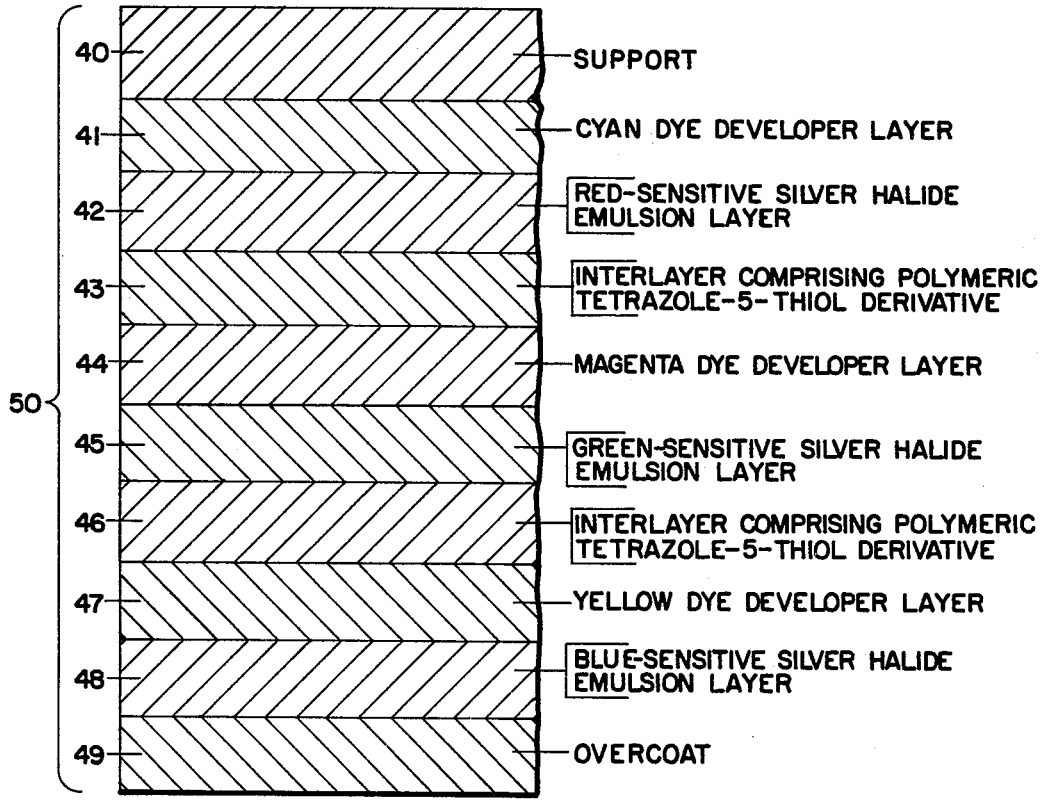

FIG. 2 depicts a photosensitive element of the instant invention 50, which comprises a support 40; a layer 41 containing a cyan dye developer; a layer 42 comprising a red-sensitive silver halide emulsion and a multivalent metal ion; an interlayer 43 comprising a polymeric tetrazole-5-thiol derivative detailed above; a layer 44 containing a magenta dye developer; a layer 45 comprising a green-sensitive silver halide emulsion; an interlayer 46 comprising a polymeric tetrazole-5-thiol derivative detailed above; a layer 47 containing a yellow dye developer; a layer 48 comprising a blue-sensitive silver halide emulsion; and a protective overcoat layer 49.

The present invention will be illustrated with the following examples which set out the use of the polymeric derivatives of the tetrazole-5-thiol in conjunction with multivalent metal ions for interimage control.

EXAMPLE 1

A control photosensitive element was prepared by coating in succession on a 4 mil polyester clear film base, the following layers:

| Layer | Component(s) | Coverage (mgs/ft$^2$) |
|---|---|---|
| (1) | a. cyan dye developer | 70 |
| | b. gelatin | 78 |
| (2) | a. red-sensitive gelatino silver iodobromide emulsion | 140 |
| | b. gelatin | 62 |
| | c. calcium nitrate | 15 |
| (3) | a. BDSM* | 100 |
| | b. polyacrylamide | 5 |
| | c. succinaldehyde | 5 |
| (4) | a. magenta dye developer | 65 |
| | b. gelatin | 85 |
| (5) | a. green-sensitive gelatino silver iodobromide emulsion | 80 |
| | b. gelatin | 35 |
| | c. calcium nitrate | 15 |
| (6) | a. BDSM* | 100 |
| | b. polyacrylamide | 5 |
| | c. succinaldehyde | 5 |
| (7) | a. yellow dye developer | 85 |
| | b. gelatin | |
| (8) | a. blue-sensitive gelatino silver iodobromide emulsion | 140 |
| | b. gelatin | 53 |
| | c. calcium nitrate | 15 |
| (9) | a. 4' methylphenyl hydroquinone | 30 |
| | b. gelatin | 30 |

where BDSM* is 60-30-4-6 copolymer of butylacrylate, diacetone acrylamide, styrene and methacrylic acid, the cyan dye developer is:

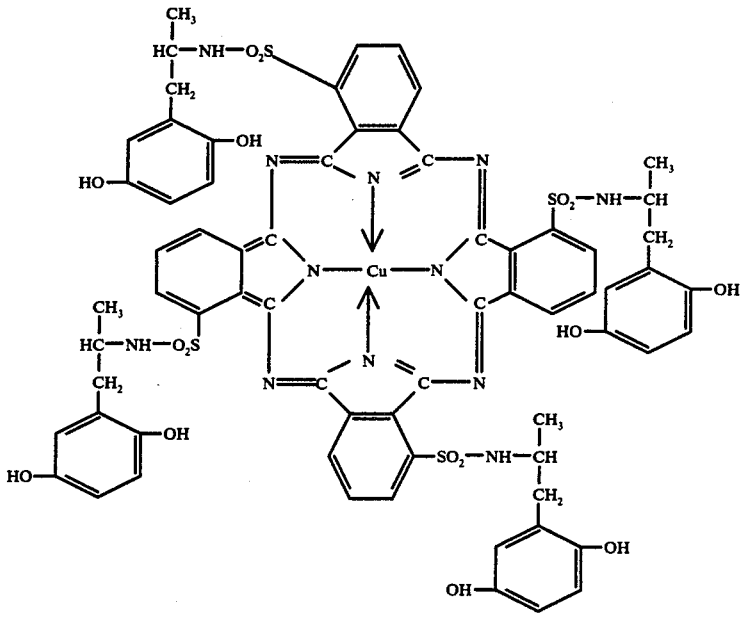

the magenta dye developer is:

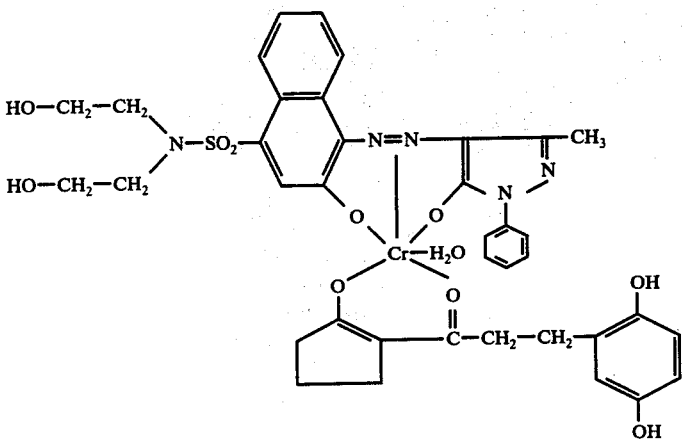

and the yellow dye developer is:

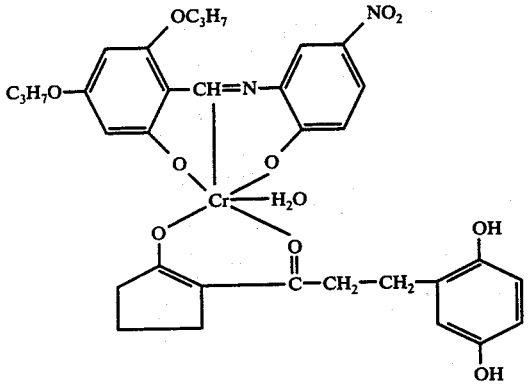

This control photosensitive element is designated CPS-I.

The test photosensitive elements designated as TPS-I and TPS-II were prepared on 4 mil polyester clear film base as follows. For TPS-I the following layers were coated in succession:

| Layer | Component(s) | Coverage (mgs/ft$^2$) |
|---|---|---|
| (1) | a. cyan dye developer | 70 |
| | b. PVPTT | 11.3 |
| (2) | a. red-sensitive gelatino silver iodobromide emulsion | 140 |
| | b. gelatin | 140 |
| | c. calcium nitrate | 15 |
| (3) | a. magenta dye developer | 65 |
| | b. PVPTT | 20.2 |
| | c. succinaldehyde | 5 |
| (4) | a. green-sensitive gelatino silver iodobromide emulsion | 80 |
| | b. gelatin | 120 |
| | c. calcium nitrate | 15 |
| (5) | a. BDSM* | 80 |
| | b. polyacrylamide | 4 |
| | c. succinaldehyde | 4 |
| (6) | a. yellow dye developer | 85 |
| | b. gelatin | 50 |
| (7) | a. blue-sensitive gelatino silver iodobromide emulsion | 120 |
| | b. gelatin | 60 |

-continued

| Layer | Component(s) | Coverage (mgs/ft$^2$) |
|---|---|---|
| | c. calcium nitrate | 15 |
| (8) | a. 4' methylphenylhydroquinone | 30 |
| | b. gelatin | 30 |

where PVPTT is the potassium salt of poly [1-(p-vinylphenyl) 1, 2, 3, 4-tetrazole-5-thiol], BDSM is as noted above in CPS-I and the cyan, magenta and yellow dye developers are as above in CPS-I.

For TPS-II the following layers were coated in succession:

| Layer | Component(s) | Coverage (mgs/ft$^2$) |
|---|---|---|
| (1) | as in TPS-I | |
| (2) | " | |
| (3) | " | |
| (4) | " | |
| (5) | a. yellow dye developer | 85 |
| | b. PVPTT | 13.6 |
| | c. succinaldehyde | 4 |
| (6) | a. blue-sensitive gelatino silver iodobromide emulsion | 120 |
| | b. gelatin | 110 |
| | c. calcium nitrate | 15 |
| (7) | a. 4' methylphenylhydroquinone | 30 |
| | b. gelatin | 30 |

where PVPTT is as noted above.

A transparent 4 mil polyethylene terephthalate film base was coated, in succession, with the following layers to form an image-receiving component:

1. as a polymeric acid layer, the partial butyl ester of polyethylene/maleic anhydride copolymer at a coverage of about 2,500 mgs./ft.$^2$;

2. a timing layer containing about a 93:7 ratio of a 60-30-4-6 copolymer of butylacrylate, diacetone, acrylamide, styrene and methacrylic acid and polyvinyl alcohol at a coverage about 500 mgs./ft.$^2$;

3. a polymeric image-receiving layer containing a 2:1 mixture, by weight, of polyvinyl alcohol and poly-4-vinylpyridine, at a coverage of about 300 mgs./ft.$^2$ The photosensitive elements were then exposed and processed in the dark by spreading an aqueous liquid processing composition comprising:

| | |
|---|---|
| Potassium hydroxide(85%) | 4.59 g. |
| N-benzyl-α-picolinium bromide (50% solution in water) | 1.25 g. |
| N-phenethyl-α-picolinium bromide | 0.72 g. |
| Sodium carboxymethyl cellulose (hercules Type 7H4F providing a | |

-continued

| | |
|---|---|
| viscosity of 3,000 cps. at 1% in water at 25 C.) | 1.07 g. |
| Titanium dioxide | 41.8 g. |
| 6-methyl uracil | 0.29 g. |
| bis-(β-aminoethyl)-sulfide | 0.02 g. |
| Lithium nitrate | 0.1 g. |
| Benzotriazole | 0.56 g. |
| 6-methyl-5-bromo-4-azabenzimidazole | 0.03 g. |
| Colloidal silica aqueous dispersion (30% $SiO_2$) | 1.82 g. |
| N-2-hydroxyethyl-N,N',N'-tris-carboxymethyl-ethylene diamine | 0.83 g. |
| Lithium hydroxide | 0.2 g. |
| 6-benzylamino-purine | 0.39 g. |
| Polyethylene glycol (molecular weight 6,000) | 0.54 g. |
| | 2.70 g. |

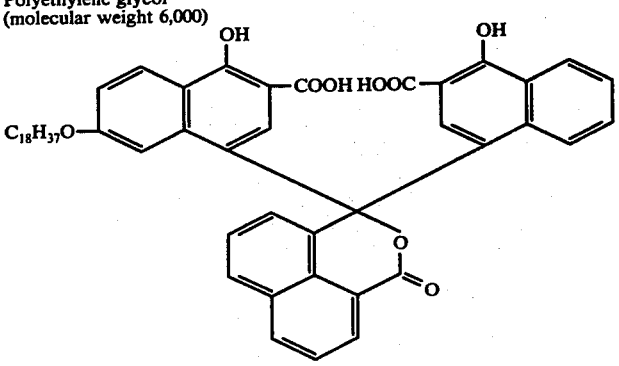

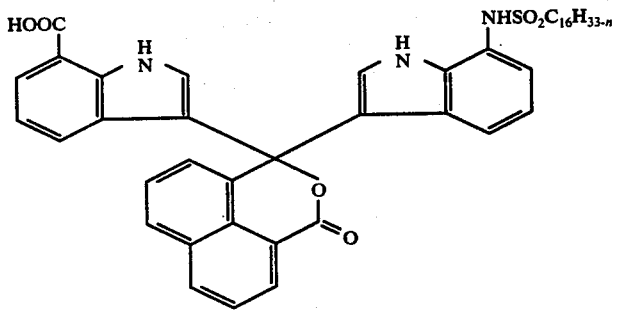

0.6 g.

Water to make 100 g.

between an image receiving element and an exposed photosensitive element as they were brought into superposed relationship. Immediately the superposed elements were placed in a light tight box.

After a dark time of 10 minutes, the superposed elements were viewed in room light. It was found in both cases, that is, with the potassium salt of poly[1-(p-vinylphenyl) 1, 2, 3, 4-tetrazole-5-thiol] as the dispersant for the cyan and magenta dye developers and with the potassium salt of poly[1-p-vinylphenyl) 1, 2, 3, 4-tetrazole-5-thiol] as the dispersant for the cyan, magenta and yellow dye developers, that maximum densities, interimage control and processing temperature latitudes of the test samples, TSP-I and TSP-II were quite generally similar to those of the control, CPS-I.

EXAMPLE 2

A photosensitive element, PE-2a, was prepared by coating in succession on a 4 mil polyester clear film base, the following layers:

| Layer | Component(s) | Coverage (mgs/ft$^2$) |
|---|---|---|
| (1) | a. cyan dye developer | 70 |
| | b. gelatin | 100 |
| (2) | a. red-sensitive gelatino silver iodobromide emulsion | 140 |
| | b. gelatin | 70 |
| (3) | a. magenta dye developer | 65 |
| | b. PVPTT | 40 |

-continued

| Layer | Component(s) | Coverage (mgs/ft$^2$) |
|---|---|---|
| | c. succinaldehyde | 5 |
| (4) | a. green-sensitive gelatino silver iodobromide emulsion | 80 |
| | b. gelatin | 40 |
| (5) | a. BDSM* | 100 |
| | b. polyacrylamide | 5 |
| | c. succinaldehyde | 5 |
| (6) | a. yellow dye developer | 85 |
| | b. gelatin | 50 |
| (7) | a. blue-sensitive gelatino silver iodobromide emulsion | 120 |
| | b. gelatin | 60 |
| (8) | a. 4' methylphenyl hydroquinone | 15 |
| | b. gelatin | 30 |

where BDSM is 60-30-4-6 copolymer of butylacrylate, diacetone acrylamide, styrene and methacrylic acid, and the cyan, magenta, and yellow dye developers are as in Example 1.

A further photosensitive element, PE2b, was prepared as above with the addition of 5 mg. of nickel nitrate to layer (2). These photosensitive elements were exposed, processed with the aqueous liquid processing composition of Example 1 and brought into superposed relationship with an image-receiving component as detailed in Example 1. After a dark processing time of 10 minutes, the superposed elements were viewed in room light. It was found that good interimage control was obtained in PE-2*a* which maximum density was satisfactory in both red and green. The results in PE-2*b* showed that interimage control can be retained with acceptable density maxima. Evidently what is occurring is that the polyvalent metal, upon diffusion into the interlayer is "loosening" the interlayer, that is, increasing the permeability of the interlayer to the diffusing dye image-forming material.

EXAMPLE 3

A control photosensitive element was prepared by coating in succession on a 4 mil polyester clear film base, the following layers:

| Layer | Component(s) | Coverage (mgs/ft$^2$) |
|---|---|---|
| (1) | a. cyan dye developer | 70 |
| | b. gelatin | 78 |
| (2) | a. red-sensitive gelatino silver iodobromide emulsion | 140 |
| | b. gelatin | 62 |
| | c. calcium nitrate | 15 |
| (3) | a. BDMS* | 100 |
| | b. polyacrylamide | 5 |
| | c. succinaldehyde | 5 |
| (4) | a. magenta dye developer | 65 |
| | b. gelatin | 85 |
| (5) | a. green-sensitive gelatino silver iodobromide emulsion | 80 |
| | b. gelatin | 35 |
| | c. calcium nitrate | 15 |
| (6) | a. BDSM* | 100 |
| | b. polyacrylamide | 5 |
| | c. succinaldehyde | 5 |
| (7) | a. yellow dye developer | 85 |
| | b. gelatin | |
| (8) | a. blue-sensitive gelatino silver iodobromide emulsion | 120 |
| | b. gelatin | 53 |
| (9) | a. 4' methylphenyl hydroquinone | 30 |
| | b. gelatin | 30 |

where BDSM is noted above in CPS-I and the cyan, magenta and yellow dye developers are as above in CPS-I.

A test photosensitive element was prepared by coating in succession on a 4 mil polyester clear film base, the following layers:

| Layer | Component(s) | Coverage (mgs/ft$^2$) |
|---|---|---|
| (1) | a. cyan dye developer | 70 |
| | b. gelatin | 78 |
| (2) | a. red-sensitive gelatino silver iodobromide emulsion | 140 |
| | b. gelatin | 62 |
| | c. calcium nitrate | 15 |
| (3) | PVPTT | 40 |
| | b. succinaldehyde | 5 |
| (4) | magenta dye developer | 65 |
| | b. gelatin | 85 |
| (5) | a. green-sensitive gelatino silver iodobromide emulsion | 80 |
| | b. gelatin | 35 |
| | c. calcium nitrate | 15 |
| (6) | a. PVPTT | 40 |
| | b. succinaldehyde | 5 |
| (7) | a. yellow dye developer | 85 |
| | b. gelatin | 67 |
| (8) | a. blue-sensitive gelatino silver iodobromide emulsion | 120 |
| | b. gelatin | 53 |
| (9) | a. 4' methylphenyl hydroquinone | 30 |
| | b. gelatin | 30 |

where PVPTT is as noted in Example I. These photosensitive elements were exposed, processed with the aqueous liquid processing composition of Example I and brought into superposed relationship with the image-receiving component as detailed in Example I. After a dark processing time of 10 minutes, the superposed elements were viewed in room light. It was found that good interimage control was obtained in the test photosensitive element and that red, green and blue density maxima were each higher in the test than in the control.

Throughout the specification and claims, the expression "superposed" has been used. This expression is intended to cover the arrangement of two layers in overlying relation to each other either in face-to-face contact or in separated condition and including between them at least a layer of fluid processing composition.

It also will be recognized that, where desired the film unit structure may also comprise an integral positive/-negative construction carried on a single support.

In addition to the described layers, it will be recognized that the film unit may also contain one or more subcoats or layers, which, in turn, may contain one or more additives such as plasticizers, intermediate layers for the purpose, for example, of improving adhesion, and that any one or more of the described layers may comprise a composite of two or more of the same, or different, components, and which may be contiguous, or separated from each other as, for example, two or more neutralizing layers, or the like, any one of which may be dispersed intermediate the cyan dye image-forming component retaining layer and the dimensionally stable base.

Since certain changes may be made in the above product and process without departing from the scope of the invention herein involved, it is intended that all matter contained in the above description or shown in the accompanying drawings shall be interpreted as illustrative and not in a limiting sense.

What is claimed is:

1. A diffusion transfer photosensitive element which comprises (a) a support layer;

(b) at least two selectively sensitized silver halide emulsion layers each having associated therewith a dye image-forming material; and (c) an interlayer intermediate said emulsion layers comprising a compound Serial No. 718,043

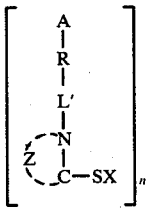

wherein A is an ethylenically unsaturated group which has been polymerized, R is a resonance stabilized group, L' is an optional linking group, X is alkali metal or primary, secondary, tertiary or quaternary ammonium, Z represents the atoms and bonds necessary to complete a 1, 2, 3, 4-tetrazole ring and *n* is an integer of at least 100; and (d) a multivalent metal cation located in said interlayer in a sufficient concentration to increase the permeability of said interlayer to said dye image-forming material.

2. The photosensitive element of claim 1 wherein said dye image-forming material is a dye which is a silver halide developing agent.

3. The photosensitive element of claim 1 wherein A is vinyl and R is phenylene.

4. The photosensitive element of claim 1 wherein X is alkali metal, ammonium, or quaternary ammonium.

5. The photosensitive element of claim 4 wherein X is sodium.

6. The photosensitive element of claim 4 wherein X is potassium.

7. The photosensitive element of claim 1 wherein A is vinyl, R is phenylene and L' is methylene.

8. The photosensitive element of claim 7 wherein X is potassium.

9. The photosensitive element of claim 1 wherein A is acrylamido, and R is phenylene.

10. The photosensitive element of claim 9 wherein X is alkali metal, ammonium or quaternary ammonium.

11. The photosensitive element of claim 1 in which at least one of the silver halide emulsion layers is next adjacent said interlayer and said multivalent metal cation is a divalent metal cation.

12. The photosensitive element of claim 11 in which said dye image-forming material is a dye which is a silver halide developing agent.

13. The photosensitive element of claim 11 in which X is alkali metal, ammonium or quaternary ammonium.

14. The photosensitive element of claim 13 wherein X is potassium.

15. The photosensitive element of claim 11 wherein said divalent cation is nickel.

16. The photosensitive element of claim 11 wherein said divalent cation is calcium.

17. In combination, (I) a diffusion transfer photosensitive element which comprises (a) a support layer;

(b) at least two selectively sensitized silver halide emulsion layers each having associated therewith a dye image-forming material; and (c) an interlayer intermediate said emulsion layers comprising a compound

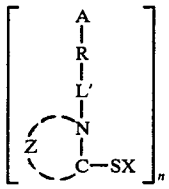

wherein A is an ethylenically unsaturated group which has been polymerized, R is a resonance stabilized group, L' is an optional linking group, X is alkali metal or primary, secondary, tertiary or quaternary ammonium, Z represents the atoms and bonds necessary to complete a 1, 2, 3, 4-tetrazole ring and n is an integer of at least 100, combined with (II) a rupturable pod containing processing an aqueous alkaline composition for said photosensitive element and a multivalent metal cation in a sufficient concentration to increase the permeability of said interlayer to said dye image-forming material.

18. The photosensitive element of claim 17 wherein A is vinyl or acrylamido and R is phenylene.

19. The photosensitive element of claim 17 wherein X is alkali metal, ammonium or quaternary ammonium.

20. The photosensitive element of claim 17 wherein X is sodium or potassium.

21. The photosensitive element of claim 17 wherein A is vinyl, R is phenylene and L' is methylene.

22. The photosensitive element of claim 17 wherein said multivalent metal cation is a divalent metal cation.

23. The photosensitive element of claim 17 wherein said divalent metal cation is nickel or calcium.

24. A photographic film unit which comprises, a photosensitive element having a diffusion transfer image-receiving element affixed upon one edge thereof, said photosensitive element containing a plurality of layers including, in sequence:

(a) a support layer;

(b) a cyan dye-image-forming-material-containing layer;

(c) a red-sensitive gelatino-silver halide emulsion layer;

(d) an interlayer;

(e) a magenta dye-image-forming-material-containing layer;

(f) a green-sensitive gelatino-silver-halide emulsion layer;

(g) an interlayer;

(h) a yellow dye-image-forming-material-containing layer; and (i) a blue-sensitive gelatino-silver halide emulsion layer; wherein at least one of said interlayers comprises a compound

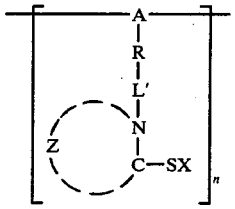

wherein A is an ethylenically unsaturated group which has been polymerized, R is a resonance stabilized group, L' is an optional linking group, X is alkali metal or primary, secondary, tertiary or quaternary ammonium, Z represents the atoms and bonds necessary to complete a 1,2,3,4-tetrazole ring and *n* is an integer of at least 100, said photosensitive element further comprising a multivalent metal cation adapted to diffuse to said interlayer comprising the compound of the above formula, said cation being in a layer other than said interlayer comprising the compound of the above formula in a sufficient concentration to increase the permeability of said interlayer to said dye image-forming material after said cation has diffused into said interlayer.

25. The photographic film unit of claim 25 wherein each of said cyan, magenta and yellow dye image-forming materials is a dye developer.

26. The photographic film unit of claim 24 wherein X is alkali metal, ammonium or quaternary ammonium.

27. The photographic film unit of claim 24 wherein said multivalent metal cation is a divalent cation.

28. The photographic film unit of claim 27 wherein said divalent cation is calcium.

29. The photographic film unit of claim 27 wherein said divalent cation is nickel.

30. A photographic film unit which comprises, a photosensitive element having a diffusion transfer image-receiving element affixed upon one edge thereof, said photosensitive element containing a plurality of layers including, in sequence:

(a) a support layer;
(b) a cyan dye-image-forming-material-containing layer;
(c) a red-sensitive gelatino-silver halide emulsion layer;
(d) an interlayer;
(e) a magenta dye-image-forming-material-containing layer;
(f) a green-sensitive gelatino-silver-halide emulsion layer;
(g) an interlayer;
(h) a yellow dye-image-forming-material-containing layer; and
(i) a blue-sensitive gelatino-silver halide emulsion layer;

wherein at least one of said interlayers comprises a compound

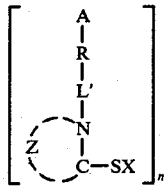

wherein A is an ethylenically unsaturated group which has been polymerized, R is a resonance stabilized group, L' is an optional linking group, X is alkali metal or primary, secondary, tertiary or quaternary ammonium, Z represents the atoms and bonds necessary to complete a 1, 2, 3, 4-tetrazole ring and *n* is an integer of at least 100, said photosensitive element further comprising a multivalent metal cation in said interlayer in sufficient concentration to increase the permeability of said interlayer to said dye image-forming material.

31. The photosensitive element of claim 30 wherein A is vinyl or acrylamido and R is phenylene.

32. The photosensitive element of claim 30 wherein X is alkali metal, ammonium or quaternary ammonium.

33. The photosensitive element of claim 30 wherein X is sodium or potassium.

34. The photosensitive element of claim 33 wherein A is vinyl, R is phenylene and L' is methylene.

35. The photosensitive element of claim 30 wherein said multivalent metal cation is a divalent metal cation.

36. The photosensitive element of claim 35 wherein said divalent metal cation is nickel or calcium.

37. A diffusion transfer photosensitive element which comprises;

(a) a support layer;
(b) at least two selectively sensitized silver halide emulsion layers; and
(c) at least two dye-image-forming-material-containing layers each associated with one of said silver halide emulsion layers; wherein at least one of said dye-image-forming-material-containing layers further comprises as a dye dispersant a compound

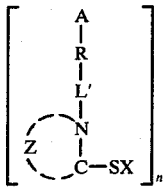

wherein A is an ethylenically unsaturated group which has been polymerized, R is a resonance stabilized group, L' is an optional linking group, X is alkali metal or primary, secondary, tertiary or quaternary ammonium, Z represents the atoms and bonds necessary to complete a 1, 2, 3, 4-tetrazole ring and *n* is an integer of at least 100, and (d) a multivalent metal cation in at least one of said dye-image-forming-material-containing layers in a sufficient concentration to increase the permeability of of said dye-image-forming-material-containing layer to said dye-image-forming material.

38. The photosensitive element of claim 37 wherein A is vinyl and R is phenylene.

39. The photosensitive element of claim 38 wherein X is alkali metal, ammonium or quaternary ammonium.

40. The photosensitive element of claim 39 wherein X is sodium.

41. The photosensitive element of claim 39 wherein X is potassium.

42. The photosensitive element of claim 37 wherein X is alkali metal, ammonium or quaternary ammonium, A is vinyl, R is phenylene and L' is methylene.

43. The photosensitive element of claim 42 wherein X is potassium.

44. The photosensitive element of claim 37 wherein A is acrylamido, and R is phenylene.

45. The photosensitive element of claim 44 wherein X is alkali metal, ammonium or quaternary ammonium.

46. In combination, (I) a diffusion transfer photosensitive element which comprises, (a) a support layer;
(b) at least two selectively sensitized silver halide emulsion layers; and
(c) at least two dye-image-forming-material-containing layers each associated with one of said silver halide emulsion layers; wherein at least one of said dye-image-forming-material-containing layers further comprises as a dye dispersant a compound

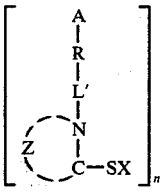

wherein A is an ethylenically unsaturated group which has been polymerized, R is a resonance stabilized group, L' is an optional linking group, X is alkali metal or primary, secondary, tertiary or quaternary ammonium, Z represents the atoms and bonds necessary to complete a 1, 2, 3, 4-tetrazole ring and *n* is an integer of at least 100, combined with (II) a rupturable pod containing processing aqueous alkaline composition for said photosensitive element and a multivalent metal cation in a sufficient concentration to increase the permeability of said dye-image-forming-material-containing layer to said dye image-forming material.

47. The photosensitive element of claim 46 wherein A is vinyl or acrylamido and R is phenylene.

48. The photosensitive element of claim 46 wherein X is alkali metal, ammonium or quaternary ammonium.

49. The photosensitive element of claim 46 wherein X is sodium or potassium.

50. The photosensitive element of claim 46 wherein A is vinyl, R is phenylene and L′ is methylene.

51. The photosensitive element of claim 46 wherein said multivalent metal cation is a divalent metal cation.

52. The photosensitive element of claim 51 wherein said divalent metal cation is nickel or calcium.

53. A photosensitive element comprising a dimensionally stable support upon which is coated at least a photosensitive silver halide emulsion layer, a dye-image-forming-material-containing layer associated with said silver halide emulsion layer, and an over-layer including a compound

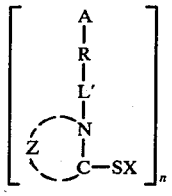

wherein A is an ethylenically unsaturated group which has been polymerized, R is a resonance stabilized group, L′ is an optional linking group, X is alkali metal or primary, secondary, tertiary or quaternary ammonium, Z represents the atoms and bonds necessary to complete a 1, 2, 3, 4-tetrazole ring and *n* is an integer of at least 100, said compound containing over-layer further comprising a multi-valent metal cation in sufficient concentration to increase the permeability of said compound-containing over-layer to said dye-image-forming material.

54. The photosensitive element of claim 53 wherein A is vinyl and R is phenylene.

55. The photosensitive element of claim 54 wherein X is alkali metal, ammonium or quaternary ammonium.

56. The photosensitive element of claim 55 wherein X is sodium.

57. The photosensitive element of claim 55 wherein X is potassium.

58. The photosensitive element of claim 53 wherein X is alkali metal, ammonium or quaternary ammonium, A is vinyl, R is phenylene and L′ is methylene.

59. The photosensitive element of claim 58 wherein X is potassium.

60. The photosensitive element of claim 53 wherein A is acrylamido, and R is phenylene.

61. The photosensitive element of claim 60 wherein X is alkali metal, ammonium or quaternary ammonium.

62. In combination (I) a photosensitive element comprising a dimensionally stable support upon which is coated at least a photosensitive silver halide emulsion stratum, a dye image-forming material and a layer including a compound

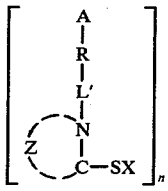

wherein A is an ethylenically unsaturated group which has been polymerized, R is a resonance stabilized group, L′ is an optional linking group, X is alkali metal or primary, secondary, tertiary or quaternary ammonium, Z represents the atoms and bonds necessary to complete a 1, 2, 3, 4-tetrazole ring and *n* is an integer of at least 100, combined with (II) a rupturable pod containing an aqueous alkaline processing composition for said photosensitive element and a multivalent metal cation in a sufficient concentration to increase the permeability of said compound containing layer to said dye-image-forming material.

63. The photosensitive element of claim 62 wherein A is vinyl or acrylamido and R is phenylene.

64. The photosensitive element of claim 62 wherein X is alkali metal, ammonium or quaternary ammonium.

65. The photosensitive element of claim 62 wherein X is sodium or potassium.

66. The photosensitive element of claim 62 wherein A is vinyl, R is phenylene and L′ is methylene.

67. The photosensitive element of claim 62 wherein said multivalent metal cation is a divalent metal cation.

68. The photosensitive element of claim 67 wherein said divalent metal cation is nickel or calcium.

* * * * *

UNITED STATES PATENT AND TRADEMARK OFFICE

CERTIFICATE OF CORRECTION

PATENT NO. : 4,102,685

DATED : July 25, 1978

INVENTOR(S) : Lloyd D. Taylor

It is certified that error appears in the above-identified patent and that said Letters Patent are hereby corrected as shown below:

Column 1, line 61 "processing" should be --processes--;

Column 3, line 47 after "assignee" insert --as the present Application--;

Column 8, No. 7B under Coverage (mgs/ft$^2$) insert --67--;

Column 14, line 41 delete heading "Serial No. 418,043";

Column 15, lines 55-56 after "containing" delete "processing" and after "alkaline" add --processing--;

Column 16, line 53 "25" should be --24--.

Signed and Sealed this

*Third* Day of *April 1979*

[SEAL]

*Attest:*

RUTH C. MASON
*Attesting Officer*

DONALD W. BANNER
*Commissioner of Patents and Trademarks*